United States Patent [19]

Gueguin

[11] Patent Number: 4,629,607

[45] Date of Patent: Dec. 16, 1986

[54] PROCESS OF PRODUCING SYNTHETIC RUTILE FROM TITANIFEROUS PRODUCT HAVING A HIGH REDUCED TITANIUM OXIDE CONTENT

[76] Inventor: Michel Gueguin, 22 Chemin Dusous Bois, Tracy, Canada, J3R 2Y5

[21] Appl. No.: 686,993

[22] Filed: Dec. 27, 1984

[51] Int. Cl.[4] ..... C01G 23/07

[52] U.S. Cl. ..... 423/74; 423/75; 75/1 T

[58] Field of Search ..... 423/74, 75; 75/1 T

[56] References Cited

U.S. PATENT DOCUMENTS

| | | | |
|---|---|---|---|
| 2,715,501 | 8/1955 | Magri, Jr. et al. . | |
| 2,747,987 | 5/1956 | Daubenspeck et al. . | |
| 2,790,703 | 4/1957 | Frey . | |
| 2,852,362 | 9/1958 | Daubenspeck et al. . | |
| 2,928,724 | 3/1960 | Mason et al. | 423/74 |
| 2,933,373 | 4/1960 | Love et al. . | |
| 3,159,454 | 12/1964 | Wilcox | 423/75 |
| 3,699,206 | 10/1972 | Dunn, Jr. . | |
| 3,803,287 | 4/1974 | Fukushima et al. . | |
| 3,868,441 | 2/1975 | Agee et al. . | |
| 3,950,489 | 4/1976 | Fukushima . | |
| 3,996,332 | 12/1976 | Elger et al. . | |
| 4,078,039 | 3/1978 | Gueguin . | |
| 4,117,076 | 9/1978 | Gueguin . | |
| 4,120,694 | 10/1978 | Elger et al. . | |
| 4,187,117 | 2/1980 | Gueguin . | |
| 4,517,163 | 5/1985 | Jodden et al. | 423/75 |

*Primary Examiner*—Herbert T. Carter

*Attorney, Agent, or Firm*—Porter & Troll Co.

[57] ABSTRACT

A process for increasing the amount of titanium dioxide in a titaniferous slag includes the rapid preheating of the slag in gases substantially void of free oxygen.

19 Claims, No Drawings

PROCESS OF PRODUCING SYNTHETIC RUTILE FROM TITANIFEROUS PRODUCT HAVING A HIGH REDUCED TITANIUM OXIDE CONTENT

BACKGROUND OF THE INVENTION

1. Field of the Invention

The present invention generally concerns a process for producing a rutilized product from titaniferous material having a high titanium dioxide content and, more particularly, pertains to a process for retaining trivalent titanium values within the slag to permit selective chlorination of impurities in a fluid bed.

2. Description of the Prior Art

In order to obtain high grade titanium dioxide, which is widely used in the process for producing pigment in the paint industry, from titaniferous ores such as ilmenities, it is necessary to remove a substantial portion of the iron values therefrom. in commercial operations, partial removal of iron values is usually achieved from a thermo-reduction or electro-smelting treatment of the titaniferous ore which reduces the iron to a metallic state thus making it easily removable from the titanium values. After the iron is removed, a concentrate containing titanium values is recovered, this concentrate being generally referred to in the industry as titaniferous slag. Typically, this slag contains approximately 80% by wt. of titannium values, 10% by wt. of iron values and less than 2 wt.% of manganese values. Additionally, the slag contains impurities such as iron, manganese, magnesium, aluminum, silicon, calcium, chromium, and vanadium, and also contains titanium dioxide and reduced titanium values, proportions of each being dependent upon the starting ore material.

The term "reduced titanium values" as used herein is synonymous with low valent titanium values and is definitive of oxidic titanium compounds and complex compositions in which the titanium values are present in the material in the trivalent or divalent state.

Many methods have been utilized to produce an even higher content titanium dioxide concentrates from the produced titaniferous slag. As is well known, a fluid bed chlorination process is one means to selectively separate the remaining iron values from the titanium values contained within the slag. However, most such chlorination methods have been plagued by the formation of ferrous chloride which, at the temperatures used, becomes a stcky paste-like condensate which clogs up the reaction bed, conduits, values and other elements of the chlorination process, thereby inhibiting the efficiency thereof. Although some commercial processes have systems which can accommodate the formation of ferrous chloride, many commercial chlorination processes cannot handle this formation and are consequently limited to chlorinating either natural or synthetic rutiles or are restricted in their use of titaniferous slag to be only a relatively small fraction of the feed to the chlorinating bed.

A proposed solution to this problem of the production of ferrous chloride is to selectively chlorinate the pre-reduced ilmenite in the presence of carbon or other carbonaceous material. As disclosed in U.S. Pat. No. 2,852,362, carbon is used in the fluid bed chlorination process to maintain the fluid bed in a substantially iron-free state. The carbonaceous material competes for the oxygen of the ferrous oxide and in so doing, the iron, during the chlorination process, more easily combines with the chlorine to produce the volatile ferric chloride which is relatively easy to remove from the fluid bed. Such formation and removal of volatile ferric chloride can be accomplished without the forfeiture of titanium values.

However, important drawbacks to this solution exist. Ilmenites, by definition, contain large amounts of iron and, consequently, require large amounts of carbonaceous material to prevent the formation of ferrous chloride. Accordingly, it has been found desirable to provide a process which removes the necessity of the use of carbonaceous material yet inhibits the formation of ferrous chloride while maintaining the desired content of the titanium values within the product.

U.S. Pat. No. 2,747,987 describes a process to upgrade the titanium within the slag by the selective chlorination of the iron values within a fluid bed to form ferric chloride. The reduced titanium content maintained in the slag is in an amount sufficient to accept substantially all of the oxygen from the iron values in the slag. This allows the chlorination process to proceed without the necessity for the presence of any carbonaceous reducing agent. The basic formula for this reaction is:

$$FeO + Ti_2O_3 + Cl_2 \rightarrow FeCl_2 + 2TiO_2$$

The ferrous oxide reacts with the reduced titanium and chlorine gas to produce ferrous chloride and titanium dioxide. Ferrous chloride is then further partially converted by the reaction with chlorine to form ferric chloride.

However, nothwithstanding the fact that the chlorination reaction is strongly exothermic, the process described by this patent is not autogenous and, therefore, essentially 80% to 90% of the titaniferous slag does not take part in the above-described reaction and, consequently, must be discharged from the fluid bed reactor at the reaction temperature, which is 900°-1000° C. Therefore, this subsequent heat loss has to be compensated by preheating the slag.

The inability of the reaction to sustain itself is complicated by the fact that it is also well known that titaniferous material is highly sensitive to oxygen. To merely heat the slag, prior to its introduction, is known to decrease the amount of reduced titanium available within the slag. U.S. Pat. No. 2,715,501 discloses that heating a titaniferous slag in air at 200° C. for one hour oxidized 19.1% of the reduced titanium. This would effectively remove this reduced titanium from becoming an acceptor of oxygen from the ferrous oxide. U.S. Pat. No. 3,868,441 further discloses that the oxidation of slag proceeds in several stages, with the oxidaton of all reduced titanium occuring at about 450° C.

SUMMARY OF THE INVENTION

It has now been discovered that by preheating the titaniferous slag in an appropriate environment, i.e. one that is substantially void of free oxygen, the reaction of the iron with the chlorine occurs throughout the slag thereby providing an efficient process for upgrading the reduced titanium within the slag.

The present invention includes an improved fluid bed process for the production of rutile from a titaniferous product which contains reduced titanium oxide by (a) preheating the titaniferous product up to a temperature of at least 700° C. by contacting it with a gas substantially void of free oxygen; (b) feeding the preheated product to a fluid bed at a temperature of at least 900° C., while maintaining the product in motion by a flow of nitrogen and chlorine gas; and (c) removing the rutile from the fluid bed. In step (a), the preheating occurs by contacting the product in a countercurrent manner with a flow of gases resulting from the combustion of a fuel and air. The various components of this preheat gas are controlled to minimize the level of free oxygen contained therein. In step (b), the nitrogen acts as an inert carrier gas, the supply of which is supplemented by the nitrogen gas recycled from the fluid bed chlorinator which is kept at a temperature of at least 900° C. In step (c), the rutile is removed from the bed by conventional means.

The present invention contemplates the use of a countercurrent flow of combustion gases to contact and preheat the titaniferous slag to a temperature of approximately 850° C. The contact with the gas is relatively short and after preheating is completed, the slag is fed into a conventional fluid bed chlorinator which has a continual feed of nitrogen and chlorine gas to maintain the slag in motion, thereby promoting a reaction between the iron and chlorine to produce volatile ferric chloride. The ferric chloride is conventionally recovered from the chlorinator and the slag is subsequently recovered, having a higher quantity of titanium dioxide contained therein. Excess nitrogen gas is recycled back into the supply of the nitrogen and chlorine gas being fed to the chlorinator.

DETAILED DESCRIPTION OF THE INVENTION

In order to further the understanding of the present invention, a proposed opertion of the process in an industrial environment will now be described.

Titaniferous slag is first obtained by any well known means and is appropriately fed into a heating means through which gases, resulting from the combustion of a fuel with air, flow in a countercurrent manner. By calculation, it has been found that approximately 1800 to 6000 cubic feet of gas per ton of slag is required to adequately preheat the slag within the heating means. The preferred range has been calculated to be 2100 to 3000 cubic feet of smelter gas per ton of slag. It, of course, must be realized that this range of values is variable and dependent upon the heat transfer efficiency and the heat losses within the proposed system. Because the amount of time for such contact between slag and gases is relatively short, preferably under 5 minutes, it is believed that the heating means could be flash heaters, as used in the calcination of lime, which could be utilized to provide for the rapid heating of the slag. The gases resulting from the combustion of the fuel, which is preferably carbon monoxide, natural, or smelter gas, and air, which can be added to various stages during the preheating phase, will normally contain water vapor, carbon dioxide and nitrogen. It has been found, as will be readily apparent from the following examples, that by adding to these gases relatively small amounts of carbon monoxide and hydrogen, the combustion gases become substantially oxygen free. This oxygen free contact thereby allows adequate heating of the slag prior to its introduciton into the chlorinator bed while simultaneously inhibiting either the reduced titanium or the iron from oxidizing.

After preheating the gas to approximately 850° C., witout any substantial loss of $Ti_2O_3$, the slag is then fed to the chlorinator which is heated to approximately 950° C. to 1050° C. The fluid bed chlorinator is simultaneously provided with a flow of nitrogen, acting as an inert carrier gas, and chlorine which reacts with the ferrous oxide to form iron chlorides. In a preferred embodiment, the molecular proportion between nitrogen and chlorine is in the range of from 5 to 1 to 2 to 1. It has been found that the most preferred molecular ration between the reduced titanium and the FeO ad MnO is one. This is to allow for a sufficient reaction between the $Ti_2O_3$ and the ferrous oxide remaining in the slag. The ferric chloride, along with the inert excess nitrogen gas, is removed from the chlorinator in a conventional manner with the nitrogen gas being recycled to supply the flow of nitrogen into the chlorinator. In a continuous operation, in as short as 30 minutes in the fluid bed, the iron is removed and the reduced titanium values are upgraded to $TiO_2$ which can be removed from the bed in a conventional manner.

EXAMPLES

1. Description of Tests and Analysis

All tests were conducted in the laboratory with the composition of the various impurities and components of the samples being identified through standard X-ray testing, wet titration analysis or atomic absorption analysis. The amount of $TiO_2$ present in a given sample was identified by a modified LaPorte method of analysis. All parts referred to in % are reported by percentage weight.

2. Description of the Preferred Embodiment

The preferred embodiment of the novel aspects of the present invention will now be described in the following non-limited examples and discussion.

EXAMPLE 1

To an externally heated 25 mm I.D., 60 cm long Vycor tube, with a porous plate sealed in the middle as gas distributor, was added 75 g of a slag having a relatively high $TiO_2$ content with a composition as follows (in %):

| $TiO_2$ | $Ti_2O_3$ | FeO | Fe Metal | $Al_2O_3$ | $SiO_2$ | CaO | MgO | MnO | $Cr_2O_3$ | $V_2O_5$ | $Nb_2O_5$ |
|---|---|---|---|---|---|---|---|---|---|---|---|
| 53.3 | 30.1 | 9.22 | 0.23 | 1.61 | 1.78 | 0.12 | 1.14 | 1.79 | 0.15 | 0.45 | 0.15 |

The slag (−595+149 microns) was fluidized by a flow of 2.5 liter/min of nitrogen and heated to 953° C. at which temperature 400 ml/min of chlorine was added to the nitrogen flow. The temperature rose sharply up to 1025° C. after 9 minutes of operation at which time excess chlorine was found in the off-gas.

After 11.5 min., the chlorine flow was stopped and the reactor purged by nitrogen and cooled down. After cooling, 68 g of upgraded product was collected and was further washed and dried to yield 66.8 g of synthetic rutile of the following composition (in %):

| $TiO_2$ | $Fe_2O_3$ | $Al_2O_3$ | $SiO_2$ | CaO | MgO | MnO | $Cr_2O_3$ | $V_2O_5$ | $Nb_2O_5$ |
|---|---|---|---|---|---|---|---|---|---|
| 94.5 | 0.66 | 1.74 | 1.76 | 0.10 | 0.59 | 0.19 | 0.11 | 0.13 | 0.15 |

This example discloses that a nitrogen preheating step will cause an upgraded titanium dioxide product in the slag. However, it is extremely expensive to preheat through the use of nitrogen and, therefore, the further examples demonstrate the parameters under which the slag can be preheated by a variety of gases produced as a result of the combustion of a fuel (smelter or natural gas) and air.

Table I shows that the particle size distribution of the product is similar to the starting slag.

TABLE I

SCREEN ANALYSIS OF PARTICLE SIZE OF SLAG AND OF SYNTHETIC RUTILE

| Micron | Slag % | Synthetic Rutile % |
|---|---|---|
| −595 + 420 | 18.68 | 19.23 |
| −420 + 297 | 35.23 | 34.43 |
| −297 + 210 | 27.85 | 30.51 |
| −210 + 149 | 13.34 | 12.73 |
| −149 + 125 | 2.84 | 2.07 |
| −125 + 105 | 1.22 | 0.72 |
| −105 | 0.84 | 0.31 |

This is of particular importance because the preferred particle size for the use of rutile in the pigment process is 100–600 microns which size, as is indicated in Table I, is maintained after processing. Therefore, the process of the present invention forms particles of synthetic rutile having increased titanium dioxide concentrates in the sizes preferred for use in producing pigment.

EXAMPLE 2

A sample of slag was treated as in Example 1 except that it was submitted for 4 minutes at 800° C. to a mixture of nitrogen (2 l/min) and $CO_2$ (1 l/min) with chlorine being introduced into the reactor at 950° C. A maximum temperature of 1008° C. was reached 7 minutes after the chlorine introduction and the test was stopped at 10 minutes time. The synthetic rutile collected had the following composition (in %):

| $TiO_2$ | $Fe_2O_3$ | $Al_2O_3$ | $SiO_2$ | CaO | MgO | MnO | $Cr_2O_3$ | $V_2O_5$ | $Nb_2O_5$ |
|---|---|---|---|---|---|---|---|---|---|
| 94.3 | 0.69 | 1.60 | 2.00 | 0.11 | 0.77 | 0.26 | 0.13 | 0.16 | 0.15 |

This example indicates that when the titaniferous product is preheated to at least 800° C., the product can be processed in a $CO_2$ environment. Under these conditions, the $CO_2$ is unable to react significantly with the slag to effect the amount of titanium dioxide produced. The ratio of preheat gases used herein is approximately equivalent to their molecular relationship from the combustion of smelter gas, i.e. $N_2$, 1.87 and $CO_2$, 0.93.

The following examples are not embodiments of the invention but pertain to the preheating step of the present invention.

EXAMPLE 3

A slag containing 32.0% $Ti_2O_3$ was preheated in a 25 mm diameter fluid bed at different temperatures and for different periods of time in a gas flow (2.8 l/min) of nitrogen and $CO_2$ mixed in equal proportion. The weight of the sample was 75 g for all the tests. The reduced titanium was analyzed after subsequent cooling of the slag in a nitrogen flow. The results are given in Table II.

TABLE II

Reduced Titanium Expressed in % $Ti_2O_3$ Remaining in a Slag Treated by a Mixture of $CO_2$—$N_2$ in Fluid Bed at Various Temperatures and for Different Periods of Time

| Temperatures | Time of Treatment 2 | 5 | 10 | 20 |
|---|---|---|---|---|
| 600 | 31.9 | 30.9 | 30.2 | 30.0 |
| 750 | 29.9 | 30.1 | 28.9 | 27.7 |
| 850 | 28.3 | 26.6 | 23.4 | 17.3 |
| 1000 | 25.0 | 20.7 | 13.6 | 6.7 |

The $Ti_2O_3$ content is not substantially decreased at 850° C. providing the time of contact with $CO_2$ is short, say 2 to 5 minutes. This indicates that when the slag is preheated, the ability of the carbon dioxide to interfere with the reduced titanium content only occurs at elevated temperatures and at longer than 5 minute time intervals. Therefore, the higher the preheat temperature is, the shorter the allowable time interval for contact between slag and $CO_2$.

EXAMPLE 4

Samples of the same slag as in Example 3, which contained 32% of reduced titanium values, expressed as $Ti_2O_3$, were treated in a flow of $N_2$—$CO_2$—CO in various proportions to simulate incomplete burning of CO gas. The remaining $Ti_2O_3$ in the slag samples expressed in % after 20 minutes of treatment at 850° C. is shown in Table III.

TABLE III

Remaining $Ti_2O_3$ (in %) in Slag Samples After Treatment at 850° C. in $N_2$—$CO_2$—CO Mixtures for 20 Minutes

| Test No. | Gas Flow Rates (ml/min) $N_2$ | $CO_2$ | CO | Ratio $CO_2$/CO | $Ti_2O_3$ (%) in Slag |
|---|---|---|---|---|---|
| 1 | 1400 | 1400 | — | — | 17.3 |
| 2 | 1350 | 1050 | 100 | 10.5 | 21.4 |
| 3 | 1230 | 970 | 300 | 3.23 | 21.4 |
| 4 | 1120 | 880 | 500 | 1.76 | 23.1 |
| 5 | 980 | 770 | 750 | 1.03 | 26.0 |

This example discloses the inhibiting effect of the use of carbon monoxide on carbon dioxide in a preheated slag environment. By increasing the molecular ratio of CO to $CO_2$ to approximately equal proportions, over a period of twenty minutes at 850° C., the interaction of the $CO_2$ with the $Ti_2O_3$ is curtailed, thereby providing increased amounts of $Ti_2O_3$ in the remaining slag. This addition of carbon monoxide makes the preheating gas substantially void of free oxygen, because the carbon monoxide competes for the free oxygen within the gases, thereby effectively reducing the amount of oxygen which can combine with the reduced titanium values.

EXAMPLE 5

Samples of the same slag as used in Examples 3 and 4, containing 32% of reduced titanium, expressed as $Ti_2O_3$, were treated in a flow of a mixture of gases in the volumetric proportions of 64% nitrogen, 32% carbon dioxide, and 4% water vapor, which simulates the combustion products of a smelter gas. The total gas flow was 2.8 l/min. Small amounts of a mixture of carbon monoxide and hydrogen (CO 85%, $H_2$ 15%) were added into the gas mixture. The treatment was carried out at 800° C. The remaining $Ti_2O_3$ in the slag samples expressed in % after 10 and 20 min. residence time in different gas mixtures is shown in Table IV.

TABLE IV

Remaining $Ti_2O_3$ (in %) in Slag Samples After Treatment at 800° C. in $N_2$—$CO_2$—$H_2O$—CO—$H_2$ Mixtures for 10 and 20 Minutes

| Test No. | Time of Treatment Min. | Percentage of CO + $H_2$ in Mixture | $Ti_2O_3$ Remaining in Sample (in %) |
|---|---|---|---|
| 1 | 10 | 1 | 27.9 |
| 2 | 20 | 1 | 25.1 |
| 3 | 10 | 2 | 27.4 |
| 4 | 20 | 2 | 24.2 |
| 5 | 10 | 5 | 28.9 |
| 6 | 20 | 5 | 25.9 |

These results disclose that even in the presence of water vapor, which is a source of oxygen and is a by-product of the combustion between a fuel and air, there is no effect of the oxygen with the $Ti_2O_3$ if CO and $H_2$ are added to the gas in appropriate amounts to make the gas substantially void of free oxygen. All of the $Ti_2O_3$ residual amounts are at least 24.2% which is considered highly favorable. Any amount over 20% is considered commercially efficient and justifiable.

While the invention has been described in detail and with reference to specific embodiments thereof, it will be apparent to one skilled in the art that various changes and modifications can be made therein without departing from the scope and spirit thereof, and therefore the invention is not intended to be limited by such description and examples.

What is claimed is:

1. An improved fluid bed process for producing a synthetic rutile from a titaniferous iron material containing reduced titanium oxide, the process including the selective chlorination of iron metal contained in the titaniferous iron material, said improvement comprising:

(a) preheating the titaniferous iron material, up to a temperature of at least 700° C., by contacting it with a heated gas substantially void of free oxygen;

(b) feeding the preheated titaniferous iron material to a fluid bed at a temperature of at least 900° C. and maintaining the material in motion in the bed by a flow of gas containing nitrogen and chlorine;

(c) removing solid synthetic rutile and gaseous chlorinated iron from the fluid bed.

2. The process as defined in claim 1, wherein the the heated gas is produced from the combustion of a fuel and air.

3. The process as defined in claim 2, wherein the heated gas contains carbon monoxide, water, hydrogen, carbon dioxide and nitrogen.

4. The process as defined in claim 2, wherein the fuel includes a smelter gas.

5. The process as defined in claim 2, wherein the fuel includes carbon monoxide.

6. The process as defined in claim 2, wherein the fuel includes natural gas.

7. The process as defined in claim 2, wherein the fuel includes an organic fuel.

8. The process as defined in claim 1, wherein the heated gas contacts the titaniferous iron material in a countercurrent manner.

9. The process as defined in claim 1, wherein the preheating occurs at a temperature between 700° C. to 900° C.

10. The process as defined in claim 1, wherein the titaniferous iron material includes slag.

11. The process as defined in claim 10, wherein the molecular ratio of $Ti_2O_3$ to FeO and MnO is approximately one.

12. The process as defined in claim 1, wherein the titaniferous iron material is sized in the range of 70 to 900 microns.

13. The process as defined in claim 12, wherein the titaniferous irom material is sized in the range of 105 to 595 microns.

14. The process as defined in claim 1, wherein the gas flow includes nitrogen and chlorine in a molecular proportion in the range between 5 to 1 and 2 to 1, respectively.

15. The process as defined in claim 1, wherein the preheating occurs in less than 5 minutes.

16. The process as defined in claim 1, wherein the titaniferous iron material remains in the fluid bed chlorinator for at least 30 minutes.

17. The fluid bed process as defined in claim 16, wherein the preheating occurs in less than 5 minutes.

18. The fluid bed process as defined in claim 16, wherein the titaniferous iron material remains in the fluid bed chlorinator for at least 30 minutes.

19. A fluid bed process for producing a synthetic rutile from a titaniferous iron material containing reduced titanium oxide by the steps of:

feeding the titaniferous iron material into a heating means;

causing a flow of substantially oxygen free heated combustion gases to countercurrently contact the titaniferous iron material in the heating means to preheat the iron material to at least 700° C.;

feeding the preheated titaniferous iron material into a fluid bed chlorinator which is maintained in a fluidized condition at a temperature of at least 900° C. and simultaneously feeding the bed with a flow of a gas which includes nitrogen and chlorine;

removing solid titanium dioxide from the fluid bed; and removing gaseous iron chlorides and excess nitrogen from the fluid bed and recycling the excess nitrogen into the flow of gas which includes nitrogen and chlorine.

* * * * *